United States Patent [19]

Webb et al.

[11] 4,306,423

[45] Dec. 22, 1981

[54] FLEXIBLE TRAY TYPE ICE MAKER

[75] Inventors: William M. Webb; Gerhard K. Losert, both of Louisville, Ky.

[73] Assignee: General Electric Company, Louisville, Ky.

[21] Appl. No.: 195,702

[22] Filed: Oct. 9, 1980

[51] Int. Cl.[3] ..... F25C 5/06

[52] U.S. Cl. ..... 62/353; 249/66 R; 62/72; 425/440

[58] Field of Search ..... 62/72, 353; 249/66, 249/69, 70; 425/436, 439, 440

[56] References Cited

U.S. PATENT DOCUMENTS

| | | | |
|---|---|---|---|
| 3,163,025 | 12/1964 | Dahlgren | 62/177 |
| 3,226,939 | 1/1966 | Harbison et al. | 62/177 |
| 3,273,353 | 9/1966 | Horvay et al. | 62/353 |
| 3,321,905 | 3/1968 | Bunnell | 249/69 |
| 3,383,876 | 5/1968 | Frohbieter | 62/72 |
| 3,540,227 | 11/1970 | Eyman, Jr. et al. | 62/137 |
| 3,545,717 | 12/1970 | Pietrzak et al. | 249/69 |
| 3,677,030 | 7/1972 | Nicholas | 62/353 |

*Primary Examiner*—William E. Tapolcai, Jr.
*Attorney, Agent, or Firm*—Frederick P. Weidner; Radford M. Reams

[57] ABSTRACT

An ice maker for use in a freezer compartment of a refrigerator including a flexible tray having cavities for forming ice pieces. The front of the ice tray has a handle and the rear has a first and second spaced guide element projecting therefrom. There is provided a support structure having a front wall with a triangular-shaped opening with all three sides of the opening being outwardly curved and dimensioned to receive therein the ice tray handle in guiding rotation thereof. There is also provided a rear wall having a track with a vertical inwardly curved portion with a terminal end at the top thereof and a horizontal downwardly curved portion joining the bottom of the vertical curved portion, said track being dimensioned to receive in guiding movement said first and second spaced guide elements on the ice tray. Upon rotation of the ice tray handle in the triangular-shaped opening, the first guide element moves in the vertical curved portion of the track and abuts the terminal end thereof and the second guide element moves in the horizontal curved portion and abuts the vertical curved portion. The guide elements and track cooperate to prevent further rotational movement of the rear of the ice tray while the front of the ice tray may continue to be rotated thus twisting the tray about its longitudinal axis to effect harvesting of the ice pieces formed in the cavities of the ice tray.

11 Claims, 9 Drawing Figures

FLEXIBLE TRAY TYPE ICE MAKER

BACKGROUND OF THE INVENTION

This invention relates to an ice maker and is particularly concerned with an ice maker of the type including a tray from which ice pieces are discharged by partially inverting and flexing the tray longitudinally to break the bond between the ice pieces and the tray walls.

In the past, various devices have been proposed or used for making, harvesting and storing ice pieces in domestic refrigerators on either an automatic or semiautomatic basis. Semiautomatic ice services of this type are shown and described, for example, in U.S. Pat. Nos. 3,163,025; 3,226,939; and 3,273,353 all of which are assigned to the same assignee as the present invention. In the ice services described in these patents, both the freezing tray and the ice storage receptacle are positioned within the freezer compartment of a refrigerator.

It is desirable to provide an ice maker which is simple, low cost and manually operable for effecting rotation of the flexible ice tray from its normal freezing position to a partially inverted position and twisting the ice tray to discharge the ice pieces and particularly such an ice maker wherein filling of the ice tray with water to be frozen to form the ice pieces is automatically provided without the need of removing the tray from the freezer compartment of the refrigerator.

By our invention, there is provided a flexible tray type ice maker that will accomplish the above desirable results and which is easy to utilize for its intended purpose.

SUMMARY OF THE INVENTION

According to one aspect of our invention, there is provided an ice maker including a flexible ice tray having cavities for forming ice pieces. The front of the ice tray has a handle and the rear of the ice tray has a first and second spaced guide element projecting therefrom. The ice maker also includes a support structure having a front wall with a triangular-shaped opening. All three sides of the triangular-shaped opening are outwardly curved and dimensioned to receive therein the ice tray handle in guiding rotation thereof. The ice maker support structure also has a rear wall with a track including a vertical inwardly curved portion with a terminal end at the top thereof and a horizontal downwardly curved portion joining the bottom of the vertical curved portion in a common area. The track is dimensioned to receive in guiding movement the first and second spaced guide elements on the ice tray. By this structure, upon manual rotation of the ice tray handle in the triangular-shaped opening in the front wall, the first guide element at the rear of the ice tray moves in the vertical curved portion of the track in the rear wall and abuts the terminal end thereof, and the second guide element moves in the horizontal curved portion and abuts the vertical curved portion in the common area. The guide elements and track cooperate to prevent further rotational movement of the rear of the ice tray while the front of the ice tray may continue to rotate thus twisting the tray about its longitudinal axis to effect harvesting of the ice pieces formed in the cavities of the ice tray.

DESCRIPTION OF THE PREFERRED EMBODIMENT

Figure 1:
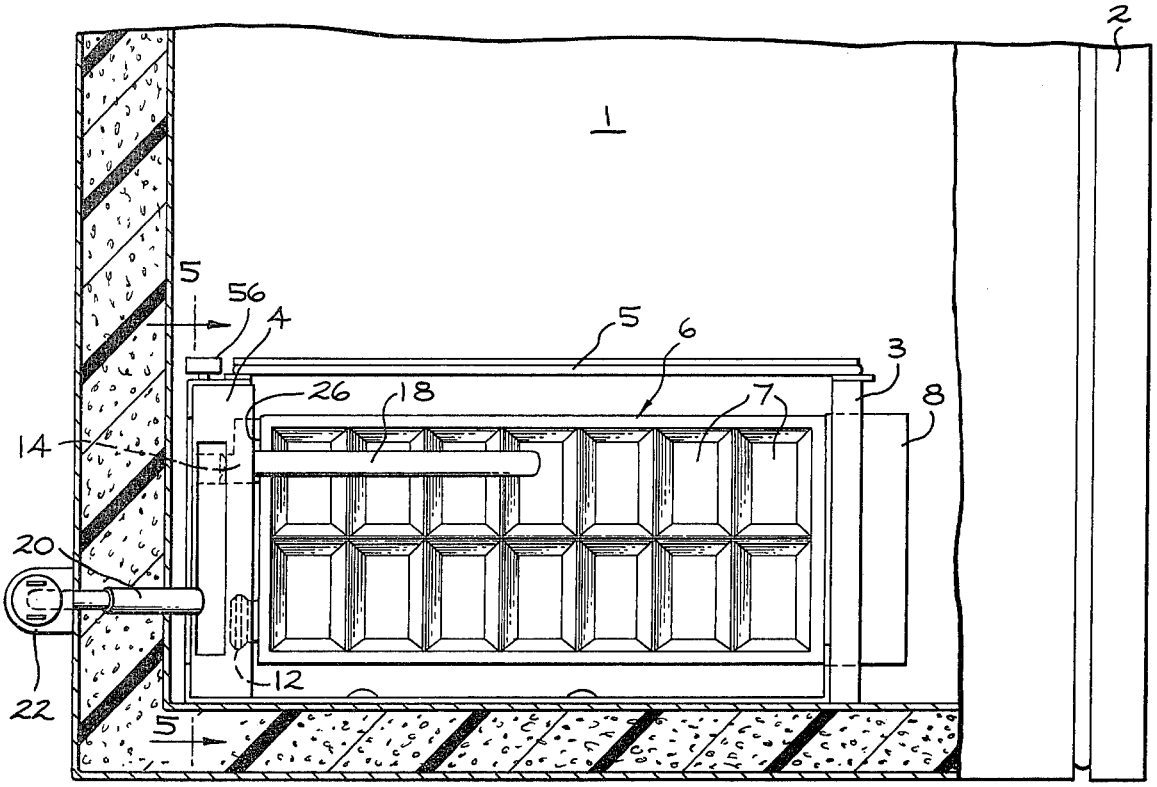
FIG. 1 is a top plan view of a portion of the freezer compartment of a household refrigerator with parts broken away to show one embodiment of the flexible tray type ice maker of the present invention.

With reference to the drawing, there is shown a household refrigerator including a freezer compartment 1 having an access opening at the front thereof closed by a door 2. It will be understood that means are also provided for maintaining the contents of the freezer compartment 1 at below freezing temperatures, such means including an evaporator forming part of the usual refrigeration system for such refrigerators.

Figure 4:
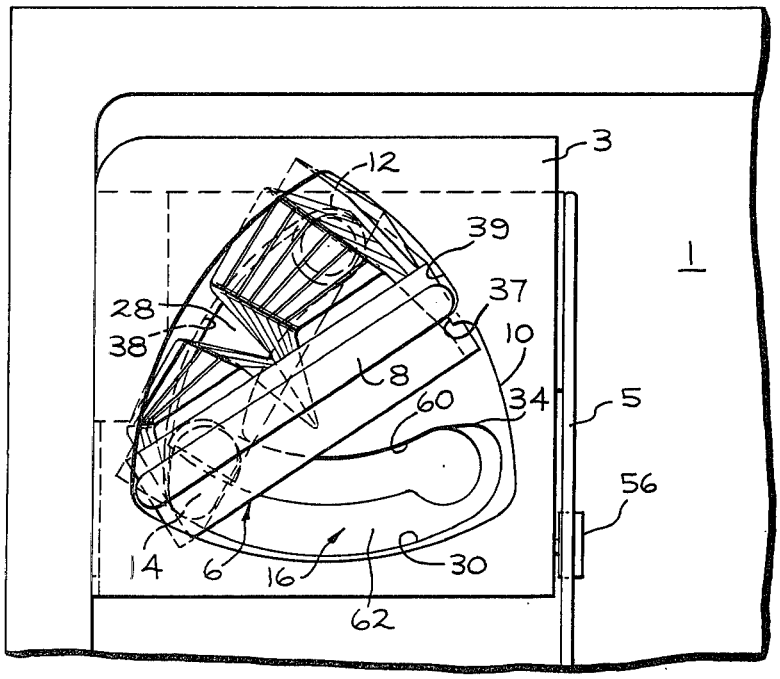
FIG. 4 is a front elevational view of one embodiment of the flexible tray type ice maker of the present invention showing the ice tray being flexed to harvest the ice pieces therefrom.
Figure 2:
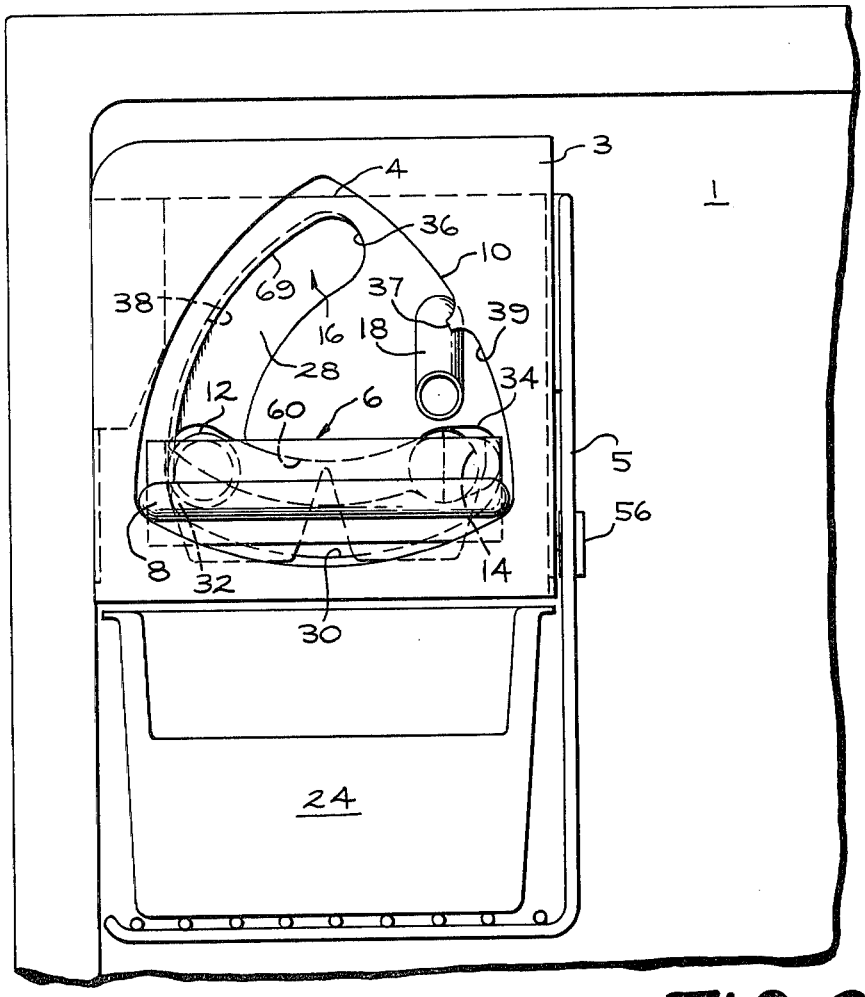
FIG. 2 is a front elevational view of one embodiment of the flexible tray type ice maker of the present invention showing the flexible ice tray in a horizontal position.
Figure 3:
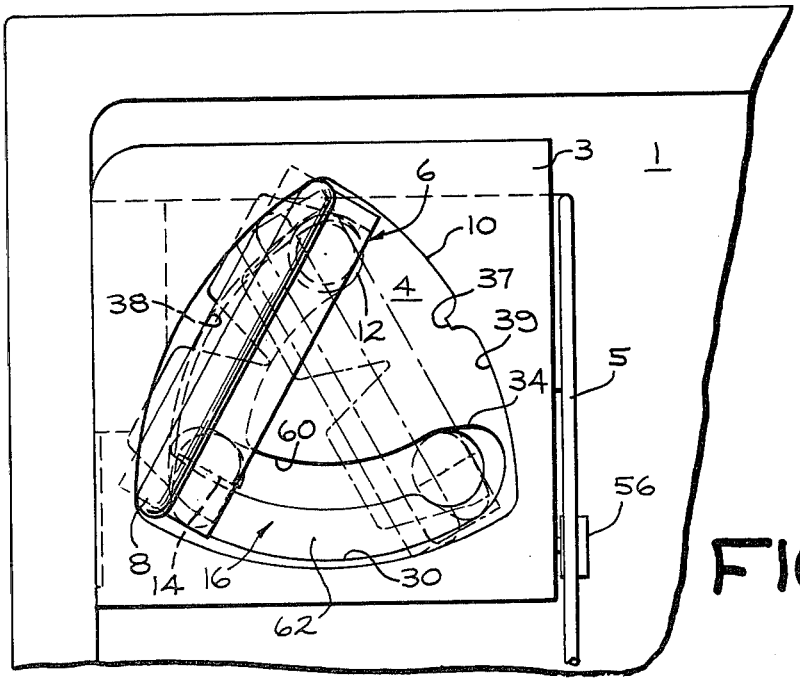
FIG. 3 is a front elevational view of one embodiment of the flexible tray ice maker of the present invention showing the flexible ice tray in a vertical partially inverted position.

The ice maker of the preferred embodiment of the present invention is mounted within the compartment 1 by any suitable support means. In the case of the preferred embodiment, the support structure of the ice maker includes a front wall 3 and rear wall 4 secured in space relationship to each other as by a frame 5 which may, in turn, be secured to a stationary member in the freezer compartment 1. A flexible ice tray 6, including a plurality of ice cavities 7 is supported at its front end on the front wall 3 by means of a handle 8 extending through and resting on the base of a triangular-shaped opening 10 in the front wall 3. The flexible ice tray 6 is supported at the rear by a first guide element 12 and a second guide element 14 spaced from each other and movably supported in a track 16 in the rear wall 4. A water fill tube or conduit 18 extends through the rear wall 4 and projects forwardly to an overlying position above the flexible ice tray 6. There is provided a water supply means comprising a water supply line 20 that connects the water fill conduit 18 with a source of water, as for example, the house water supply, through a water control valve 22. The flexible ice tray 6 shown in FIG. 1 is in its horizontal position ready for receiving either water through the water fill conduit 18 or if it is filled, it is in position for freezing the water into ice pieces and retaining the ice pieces in the ice tray 6. With particular reference to FIGS. 2, 3, and 4, the front wall 3 of the ice maker has a triangular-shaped opening 10 in the center thereof. Each of the sides of the triangular opening are curved outwardly, the purpose of which will be explained later in connection with the operation of the ice maker. The dimensions of the opening 10 are such that the flexible ice tray 6 may be removably inserted through the opening 10. As can be seen for example in FIG. 2, the width of the handle 8 is slightly greater than the width of the ice tray but slightly smaller than the distance of the base of the triangular opening 10. All three sides of the triangular-shaped opening 10 are dimensioned the same as the base, that is, all of the sides are just slightly greater than the length of the handle 8.

As can be seen particularly in FIG. 2, beneath the flexible ice tray 6 is an ice piece receptacle 24 in which ice pieces ejected or discharged from the ice tray 6 may be stored for ultimate use. Conveniently, the ice piece receptacle 24 is supported by the frame 5 so that it underlies the ice tray 6.

The rear of the flexible ice tray 6 has a wall 26 to which is secured a first guide element 12 and a second guide element 14 which are spaced from each other and located generally at opposite ends of the rear wall 26. The guide elements are horizontally oriented with respect to each other when the ice tray is in its horizontal position, as shown in FIG. 2. The track 16 in the rear wall 4 of the ice maker support structure includes a vertical inwardly curved portion 28 and a horizontal downwardly curved portion 30 both portions forming a continuous track 16. The first guide element 12 is dimensioned to be received in the vertical inwardly curved portion 28 and is movable from a common area 32 where the vertical inwardly curved portion 28 and the horizontal downwardly curved portion 30 meet along the track portion 28 to the terminal end 36. The second guide element 14 is dimensioned to be received in the horizontal downwardly curved portion 30 of the track 16 and is movable between the terminal end 34 of the horizontal downwardly curved portion 30 and the common area 32. Further structural details will be discussed subsequent to a general explanation of the operation and function of the flexible tray type ice maker as described so far.

With the above described structure, the handle 8 of flexible ice tray 6 is supported by front wall 3 of the ice maker support structure and is rotatably movable clockwise as viewed from the front of the ice maker (FIG. 2) within the triangular-shaped opening 10. The rear of the flexible ice tray 6 is supported in track 16 by the first guide element 12 and the second guide element 14. Assuming that water had been previously placed in the cavities 7 of the ice tray 6 and frozen, the user manually grips the handle 8 and rotates the flexible ice tray 6 clockwise about its longitudinal axis whereupon the ice tray will be moved from its horizontal position as shown in FIG. 2 to a vertical position shown in FIG. 3. It will be understood that upon rotational movement of the ice tray 6, the first guide element 12 will ascend in the vertical inwardly curved portion 28 of track 16 until it abuts terminal end 36 while the second guide element 14 is moved from the terminal end 34 of the horizontal downwardly curved portion 30 to the common area 32. In this position (FIG. 3), the first guide element 12 abuts the terminal end 36 of the vertical inwardly curved portion 28 and further movement is thus prevented and the second guide element 14 in area 32 abuts the side wall 38 of vertical inwardly curved portion 28. Thus, the guide elements 12 and 14 cooperate with track 16 such that the rear of the flexible ice tray 6 is prevented from further longitudinal rotation in the clockwise direction. By continuing clockwise rotation of the handle 8 at the front of the flexible ice tray 6 (FIG. 4), the tray is twisted about its longitudinal axis and when a sufficient amount of twisting is achieved, the ice pieces are released from the ice cavities 7 and fall from the flexible ice tray 6 into the underlying ice piece receptacle 24. Generally, the flexible ice tray 6 is rotated 120° about its longitudinal axis prior to initiation of the twisting of the ice tray 6 to effect release or harvesting of the ice pieces. There may be provided an ice tray stop 37 that projects inwardly from side 39 of the triangular-shaped opening 10 and is positioned to allow sufficient twisting of the ice tray to harvest the ice pieces but prevent the front of the ice tray 6 being twisted too much which could cause damage to the ice tray 6. After the ice pieces have been harvested from the ice tray 6, the ice tray 6 may be counterrotated and restored to its horizontal position ready for receiving water for subsequent freezing (FIG. 2).

In the preferred embodiment of our invention, it is desirable to have the flexible ice tray 6 automatically filled with water to the proper level after the ice pieces have been harvested and the flexible ice tray 6 is returned to its horizontal position as shown in FIG. 2. To accomplish this, the rear wall 4 of the ice maker support structure has located within its a weighing device 40 which includes a flexible ice tray support member 42 that extends generally horizontally behind the horizontal downwardly curved portion 30 of track 16. The tray support member 42 is mounted on a pivot 44 such that it may be pivotally moved about the pivot 44. One end 46 of the tray support member 42 is downwardly turned and has attached to it one end 48 of a spring 50 which extends from the end 46 of the support member 42 along and underneath the tray support member 42 and has its opposite end 52 secured to a fixed but adjustable spring retention member 54. The spring retention member 54 is threadedly engaged with a support member 55 such that rotation of the spring retention member 54 as by knob 56 moves the spring retention member 54 inwardly or outwardly of the support member 55 thus changing the tension on the spring 50.

Figure 6:
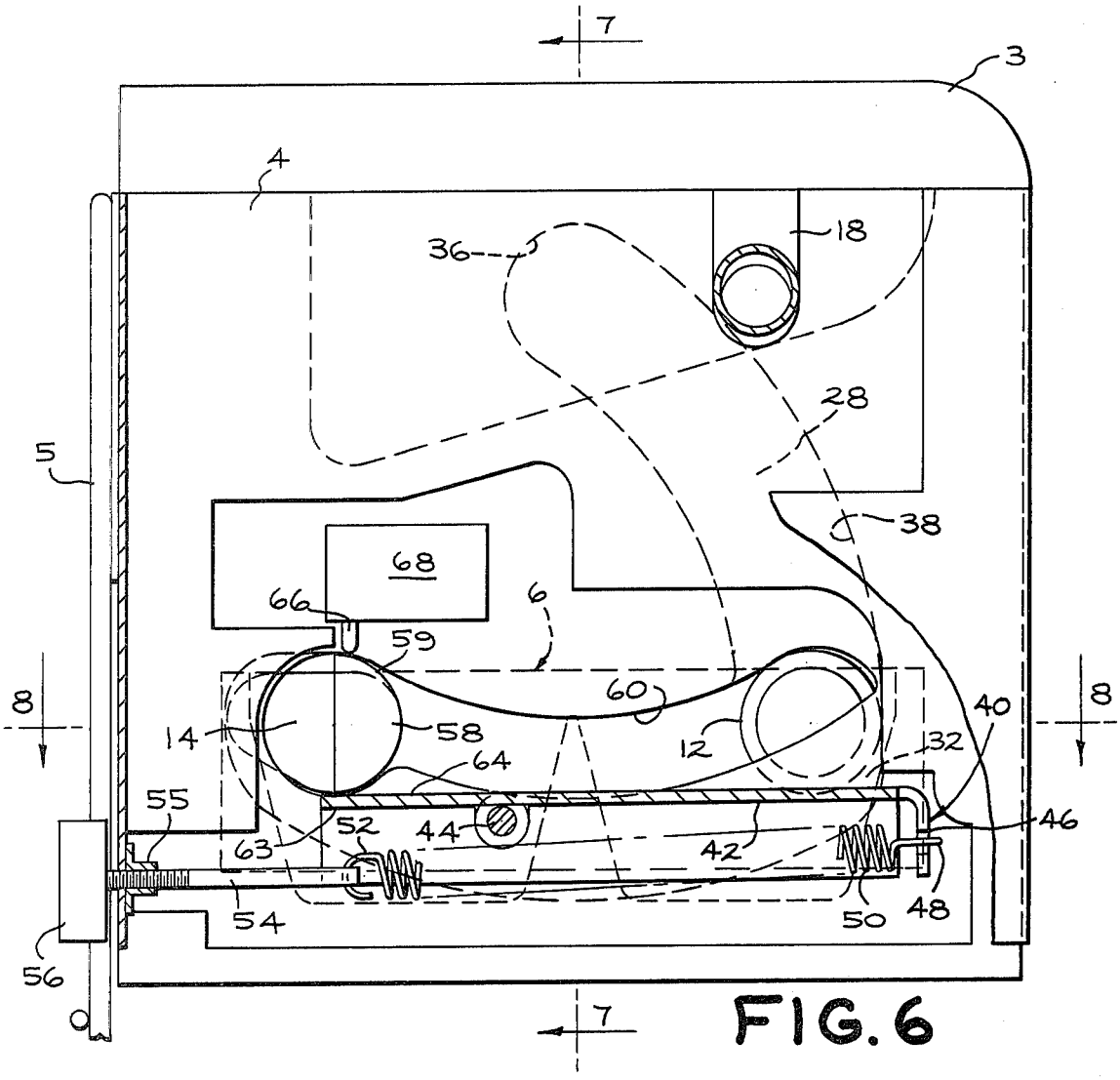
FIG. 6 is similar to FIG. 5 showing the flexible ice tray in its position when full of water or ice.
Figure 5:
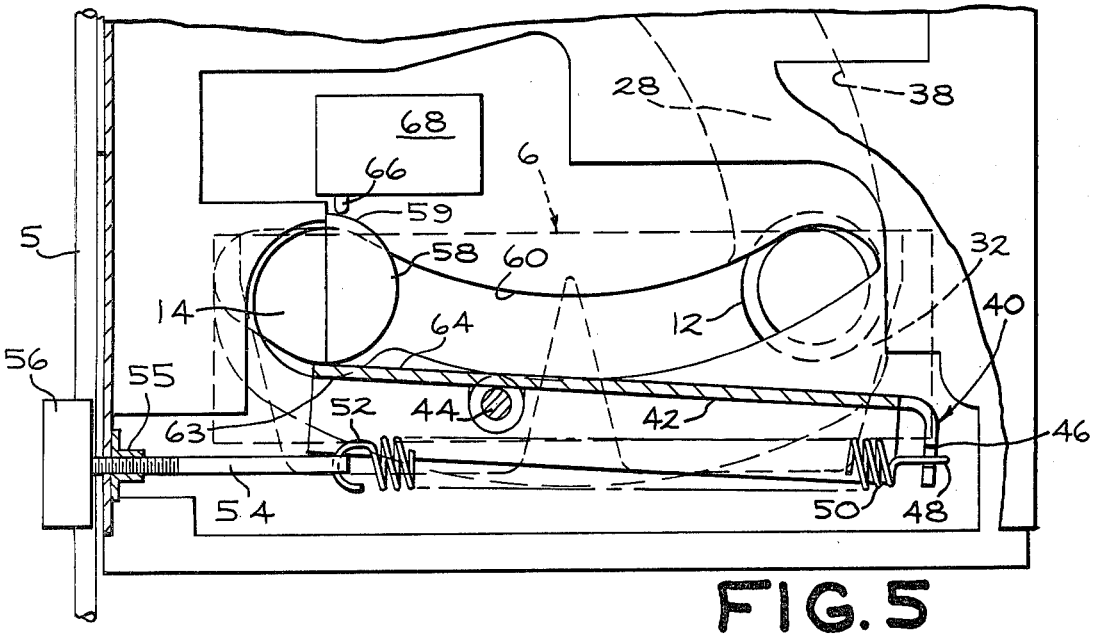
FIG. 5 is a rear elevational view of one embodiment of the flexible tray type ice maker of the present invention showing the flexible ice tray in its empty position ready for water fill.
Figure 7:
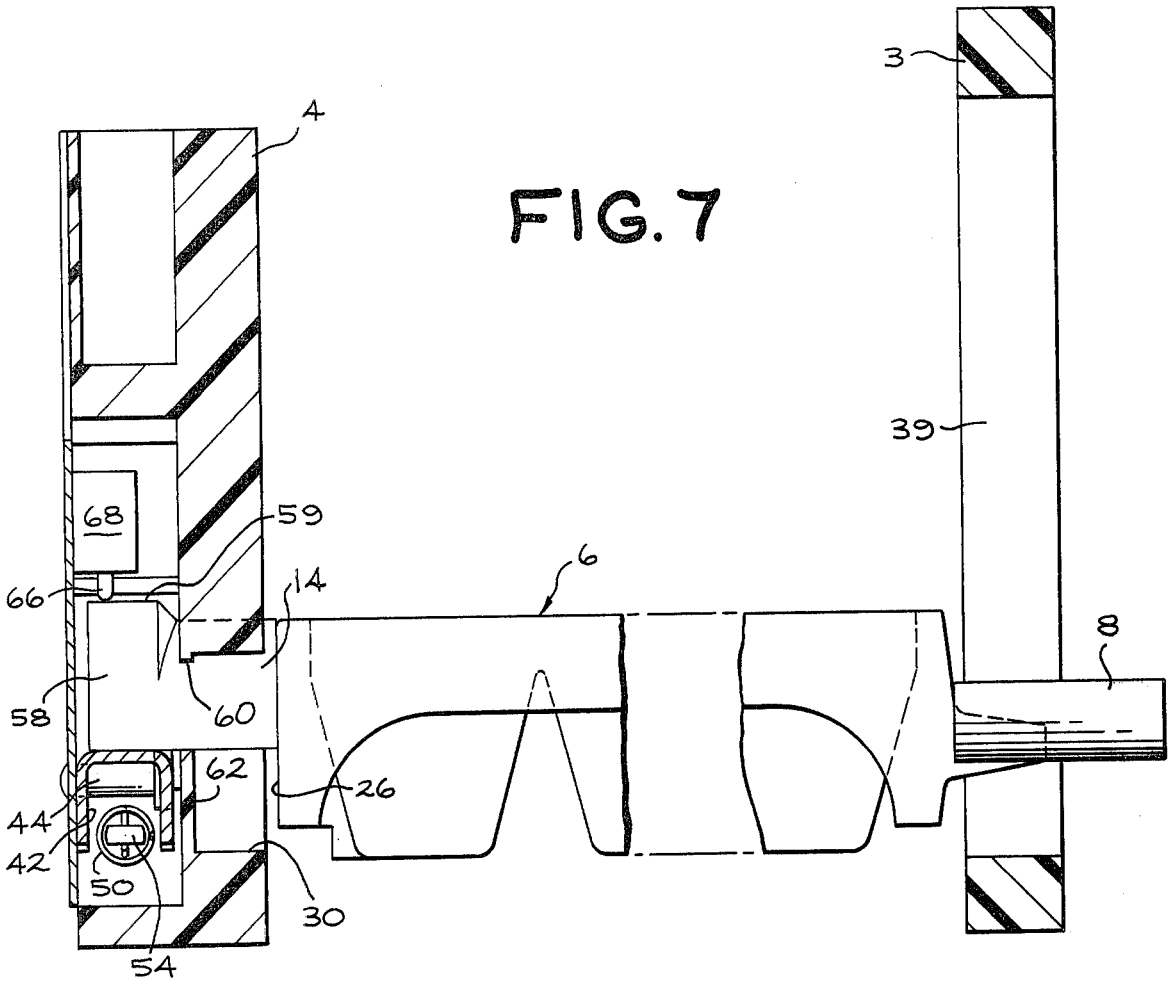
FIG. 7 is a cross sectional view of one embodiment of the flexible tray type ice maker of the present invention taken along lines 7—7 of FIG. 6.
Figure 8:
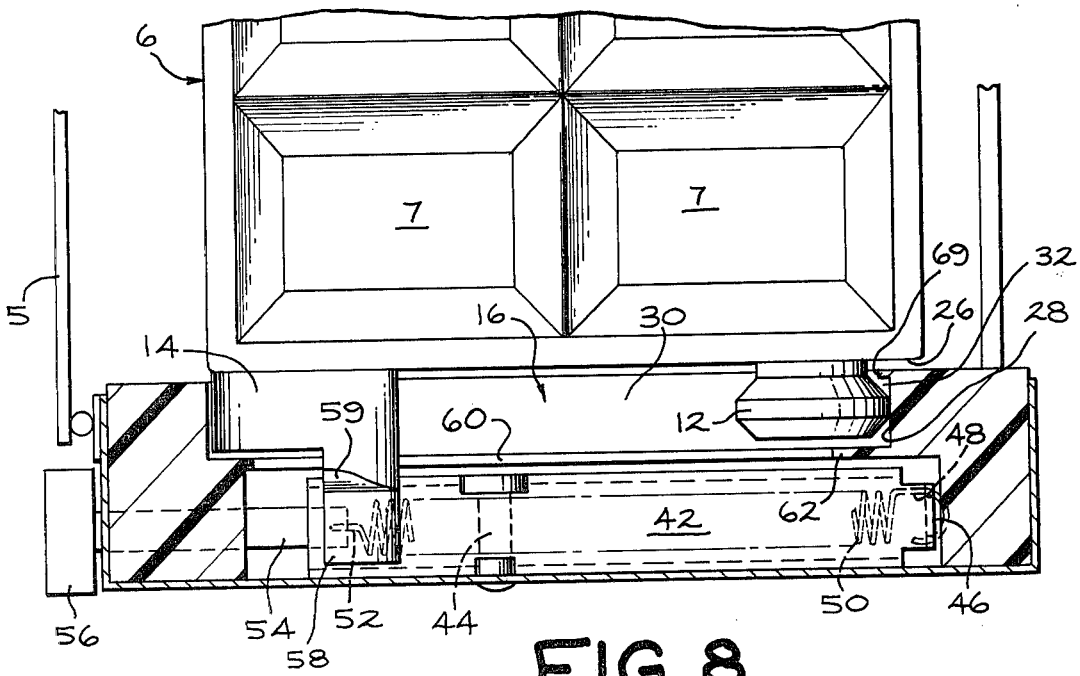
FIG. 8 is a cross sectional view of one embodiment of the flexible tray type ice maker of the present invention taken along lines 8—8 of FIG. 6.

To support the flexible ice tray 6 on the weighing device 40 and particularly the tray support member 42, the second guide element 14 has a projection 58 extending rearwardly through an opening 60 in the rear wall 62 of the horizontal downwardly curved portion 30 of track 16. The projection 58 rests on the top surface 64 of the tray support member 42 on fulcrum arm 63 and, when the ice tray 6 is empty, that position is shown in FIG. 5. It will be noted in FIG. 5 that the tray support member 42 is pivoted slightly about pivot 44 so that it is inclined downwardly toward end 46 of the support member 42 which is attached to the spring 50. In that position, the empty flexible ice tray 6 has its end to which is secured the second guide element 14 slightly raised so that an inclined ramp 59 on the projection 58 of the second guide element 14 is in contact with and depresses a plunger 66 of a switch 68. When the plunger 66 is depressed, the switch 68 is actuated and sends a signal to the water control valve 22 which allows water from the household supply to flow through the water line 20 and the water fill conduit 18 into the ice cavities 7 of the horizontal flexible ice tray 6. The water continues to flow until there is a sufficient amount in the flexible ice tray 6 such that the weight of the ice tray 6 and the water exerting itself upon fulcrum arm 63 causes the tray support member 42 to be pivoted counter-clockwise about pivot 44 to a position shown in FIG. 6. In this position, the projection 58 and its ramp 59 of second guide element 14 has been lowered away from the switch 68 and the plunger 66 is restored to a position that deactuates the switch whereupon a signal is sent to the water control valve 22 to stop the further flow of water into the flexible ice tray 6. It will be understood that by adjusting the tension on the spring 50 by means of rotating the spring retention member 54, the weight of the ice tray and water that deactuates the switch 68 may be adjusted so that a predetermined proper amount of water is introduced into the ice tray 6 during the water fill operation. In the preferred embodiment, the weighing device arrangement has the effect of a negative spring whereby it exerts a diminishing force as it is deflected downward due to the weight of the water filling the ice tray.

During the ice piece harvesting operation when the ice tray 6 is being rotated clockwise as previously described and the second guide element 14 is moved in the horizontal downwardly curved portion 30 of track 16, the projection 58 will travel in an opening 60 in the rear wall 52 of the horizontal downwardly curved portion 30. To prevent withdrawal of the ice tray guide elements 12 and 14 from the track 16 during the ice piece harvesting operation, when the first guide element 12 leaves the common area 32 and ascends the vertical inwardly curved portion 28 toward the terminal end 36, the diameter of the first guide element 12 is greater than the forward opening of the vertical inwardly curved portion 28 due to a flange 69 that extends inwardly from the common area 32 to the terminal end 36.

Figure 9:
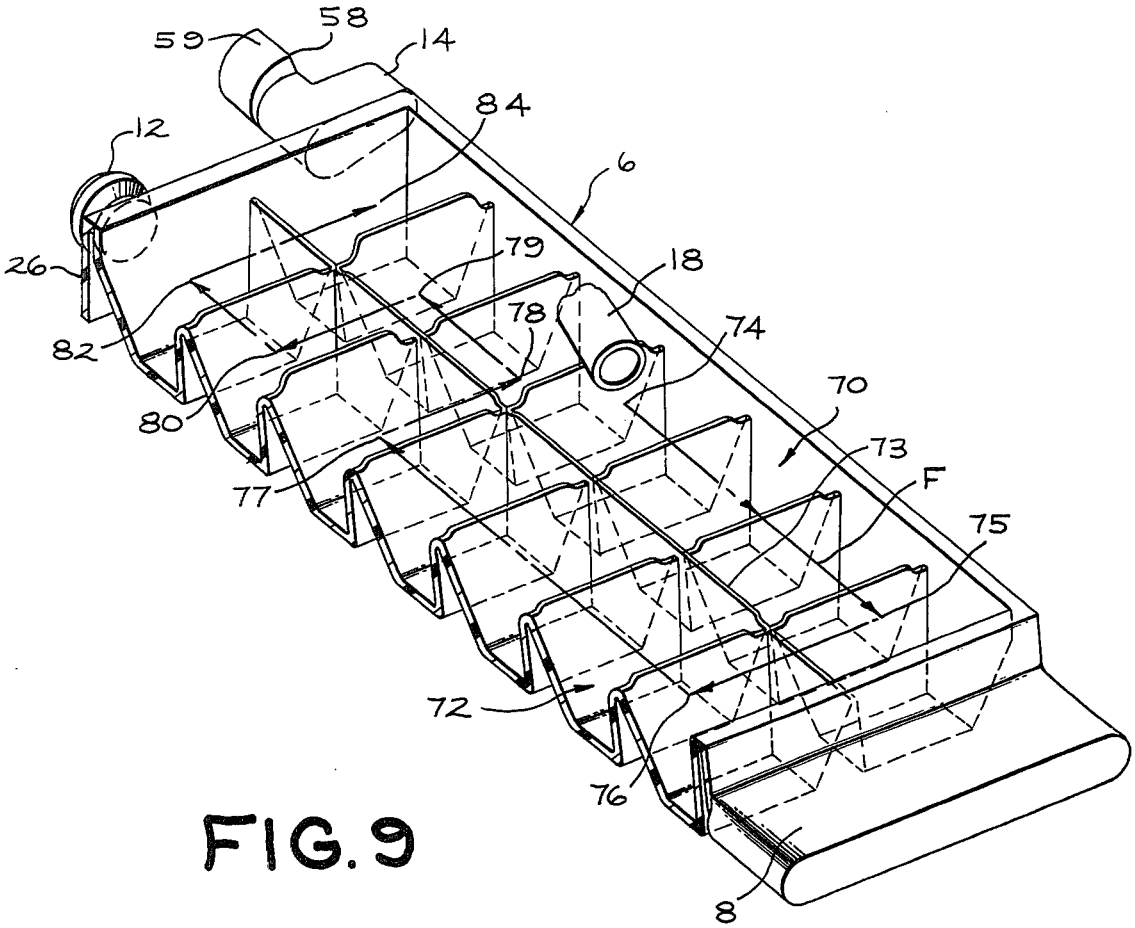
FIG. 9 is a perspective view of one embodiment of the flexible ice tray of the ice maker of the present invention.

With reference to FIG. 9, the arrangement of the ice cavities 7 in the flexible ice tray 6 is shown. In the preferred embodiment of our invention, there is a first row 70 and second row 72 of ice cavities 7 in side-by-side arrangement separated by a partition 73 along the longitudinal axis of the ice tray 6. The order of water fill of the cavities 7 is shown by a directional flow path designated F. The water flowing into the flexible ice tray 6 through the water fill conduit 18 enters in the center of the flexible ice tray 6 in a cavity 7 on the first row 70 which is designated 74 on flow path F, the start of the ice tray fill operation. As that cavity 7 fills with water, the water flow then progresses forwardly in the first row 70 as shown by the flow path F to the front of the ice tray 6 at point 75 and then leaves the first row 70 and flows across the partition 73 to point 76 of the second row 72 of cavities at the forward end of the tray. From there, the water flows in row 72 rearwardly to the cavity designated point 77, just behind the cavity in the first row 70 where the incoming water flow initiated (point 74). When that cavity is filled with water, the water then flows across the partition 73 to the first row 70 of cavities 7 to point 78 which is the cavity immediately behind the initially filled cavity. From there, the water flows rearwardly from point 78 to point 79, fills that cavity, then again crosses the partition 73 to point 80, fills that cavity, then rearwardly in the second row 72 to the last cavity in that row designated point 82. From point 82, the water flows across the partition 73 into the last cavity to be filled which is point 84. The reason for this water fill flow arrangement is so that the ice tray is filled at the front firs and the last cavity 7 to be filled in the flexible ice tray 6 is immediately adjacent to the second guide element 14 which, as previously discussed, rests on the tray support member 42 of the weighing device 40. Thus, this water fill sequence results in increasing weight on the rear end of the ice tray gradually and when the predetermined proper water fill level is reached based on the weight of the ice tray and water, the weighing device deactuates the switch 68. The water flow path F may be arranged differently but the ice tray should have the front end filled with water first and the rear end filled subsequently. It will be understood that the water flows in path F from point 74 to point 84 by having each of the cavities 7 along the path F progressively and in succession filled with water. When each cavity is filled, the water spills over into the next successive cavity and so on.

The foregoing is a description of the preferred embodiment of the invention and it should be understood that variations may be made thereto without departing from the true spirit of the invention, as defined in the appended claims.

What is claimed is:

1. An ice maker comprising:

(a) a flexible ice tray having cavities for forming ice pieces from frozen water, the front of said ice tray having a handle and the rear having first and second spaced guide elements projecting therefrom; and (b) a support structure having;

(i) a front wall with a triangular-shaped opening with all three sides of the opening being outwardly curved and dimensioned to receive therein the ice tray handle in guiding rotation thereof, (ii) a rear wall having a track with a vertical inwardly curved portion with a terminal end at the top thereof and a horizontal downwardly curved portion joining the bottom of the vertical curved portion in a common area, said track dimensioned to receive in guiding movement said first and second spaced guide elements on the ice tray, whereby upon rotation of the ice tray handle in the triangular-shaped opening in the front wall said first guide element at the rear of the ice tray moves in the vertical curved portion of the track in the rear wall and abuts the terminal end thereof and the second guide element moves in the horizontal curved portion and abuts the vertical curved portion at the common area, said guide elements and track cooperating to prevent further rotational movement of the rear of the ice tray while the front of the ice tray may continue to rotate thus twisting the tray about its longitudinal axis to effect harvesting of the ice pieces formed in the cavities of the ice tray.

2. The ice maker of claim 1 wherein the first guide element cooperates with the vertical curved portion of the track to be movable therein and unremovable therefrom when the ice tray is being rotated about its longitudinal axis.

3. The ice maker of claim 1 wherein a stop member projects into the triangular-shaped opening on the front wall of the support structure for the handle to abut upon sufficient twisting of the ice tray to harvest the ice pieces.

4. The ice maker of claim 1 wherein the flexible ice tray is rotated 120° about its longitudinal axis prior to initiation of the twisting of the ice tray to effect harvesting of the ice pieces.

5. The ice maker of claim 1 wherein means are provided to determine the need to fill the ice tray with water and automatically initiate water flow into the ice tray and terminate the water flow when the ice tray is filled with water.

6. The ice maker of claim 5 wherein a water fill conduit projects through the rear wall of the support structure and is located between the vertical curved portion and the horizontal curved portion of the track.

7. The ice maker of claim 6 wherein the water fill conduit projects to the center of the ice tray and the ice tray is arranged so that the water fills the cavities at the front of the ice tray first and then the rear of the ice tray.

8. The ice maker of claim 6 wherein the means to determine the need to fill the ice tray with water is a weighing device upon which the second guide element of the ice tray is supported when in its horizontal position.

9. The ice maker of claim 8 wherein the weighing device has the effect of a negative spring whereby it exerts a diminishing force as it is deflected downward due to the weight of the water filling the ice tray.

10. The ice maker of claim 1 wherein the width of the ice tray handle is slightly greater than the width of the ice tray.

11. The ice maker of claim 8 wherein the weighing device and second guide element cooperate to actuate and deactuate a switch that respectively initiates water flow into the ice tray and terminates the water flow when the ice tray is filled with water.

* * * * *